US007275654B2

(12) United States Patent
Christensen

(10) Patent No.: US 7,275,654 B2
(45) Date of Patent: Oct. 2, 2007

(54) TISSUE PAPER DISPENSER

(75) Inventor: Scott Christensen, Brooklyn, NY (US)

(73) Assignee: Vessel Inc, Boston, MA (US)

( * ) Notice: Subject to any disclaimer, the term of this patent is extended or adjusted under 35 U.S.C. 154(b) by 397 days.

(21) Appl. No.: 10/707,670

(22) Filed: Dec. 31, 2003

(65) Prior Publication Data

US 2005/0145641 A1 Jul. 7, 2005

(51) Int. Cl.
*B65H 1/00* (2006.01)

(52) U.S. Cl. ..... 221/33; 221/47; 221/63

(58) Field of Classification Search ..... 221/33, 221/47, 48, 63; 206/233
See application file for complete search history.

(56) References Cited

U.S. PATENT DOCUMENTS 1,464,180 A * 9/1923 Hudson ..... 221/48
1,511,812 A * 10/1924 Horwitt ..... 211/51
1,977,687 A * 10/1934 Medoff ..... 206/494
4,678,099 A 7/1987 Matsui
5,992,683 A 11/1999 Sigl
6,000,538 A * 12/1999 Lee ..... 206/233

OTHER PUBLICATIONS

Acrylic Tissue Holders; available on-line from The Container Store; http://containerstore.com/browse/Product.jhtml?PRODID=61403 &CATID=71799; author and date presently unknown.

* cited by examiner

*Primary Examiner*—David H. Bollinger
(74) *Attorney, Agent, or Firm*—Albert Peter Durigon

(57) ABSTRACT

A tissue dispenser and method includes a weighted ring or plate or other single or multi-piece member which sits on top of a stack of interleaved tissues. The ring or plate or other member has an aperture, through which the tissues are dispensed. The weight of the ring or plate or other member applies constant pressure to the stack of tissues, causing enough friction between the tissues to pull the next one partially through the aperture into the ready position.

5 Claims, 1 Drawing Sheet

TISSUE PAPER DISPENSER

BACKGROUND OF INVENTION

The current art of tissue dispensers uses a box for holding the stack of tissues. The box has an open portion at the top of the box. Sheets are folded and positioned horizontally on top of each other such that the top sheet can be removed through the open portion of the box. The sheets have a folded portion that is folded into a top folded portion of a lower sheet so that as the sheet is removed, the top portion of the subsequent sheet protrudes from the open portion for retrieval by the tissue user.

An all too typical problem with these pop-up tissue dispensing boxes is that the pop-up tissues do not regularly pop-up but rather fall into the box which makes retrieval and/or dispensing of the next sheets more difficult. The user will have to reach into the open portion of the box and retrieve the sheet. As more tissues are used, the top of the tissue stack becomes deeper in the tissue box or package. This increases the probability that the tissue will fall back into the box. Pop-up failure may also occur as a result of irregularities in the way the tissues are folded.

SUMMARY OF INVENTION

It accordingly is a principal object of the present invention to disclose a tissue sheet dispenser for dispensing tissues that overcomes the problems associated with the heretofore known devices and techniques for tissue dispensation. The tissue dispenser of the present invention includes a member adapted to seat upon a stack of tissues so as to apply a constant pressure to the stack of tissues, the member having an aperture or space adapted to allow tissues to be pulled therethrough such that as the top tissue is dispensed the next-to-top tissue is held thereby in position to be dispensed. The tissue sheets are stacked one on top of another. The tissue dispenser is positioned over the top of the stack of inter-folded tissues for allowing removal of the top tissue. The tissues are inter-folded to each other such that as a first top tissue is pulled through the aperture, the leading section of the subsequent sheet is at least partially drawn through the aperture. Once the top tissue has been removed from the tissue stack, at least a portion of the leading section of the following sheet extends through the aperture.

A first embodiment of the present invention is a circular ring adapted to seat on top of a stack of interleaved tissues having an aperture in a central region of the ring. The weight of the ring applies pressure onto the folds of the tissues, causing enough friction between the tissues to pull the next one partially through the aperture into the ready position. The combination of the weight and aperture size dispenses the top tissue without lifting the ring or tearing the tissue and holds the next tissue upright in ready position to be dispensed.

Another embodiment of the present invention is a plate structure having an aperture in a central region of the structure wherein the plate structure extends outwardly from the aperture to essentially cover a substantial portion of the top tissue.

Another embodiment of the present invention is a spaced structure, or two separate structures that are spaced apart, such that the open area allows for removal of the first tissue from the top of the stack of tissues.

Yet another embodiment of the present invention is a U-shaped structure. The U-shaped structure forms a boundary about a U-shaped open area for removal of a first tissue from the top of the stack of tissues. The open area has a bounded portion that is bounded by the U-shaped structure and an unbounded portion at the open portion of the U-shaped structure.

A device in accord with the present invention rests directly on top of the tissues, allowing gravity to apply a constant pressure to the folds, which keeps the next tissue always upright. This eliminates the problem common in boxed tissues of the next tissue falling back into the box, and requiring the user to reach through the aperture and blindly attempt to get hold of the appropriate edge of the next tissue. Any discontinuity in the flow of tissues caused by a factory missfold or other irregularity is easily restarted. A tissue dispensing device in accord with the present invention eliminates the need for the box as a means of regulating the outflow of tissues. In this way, tissue dispensation is simplified, in so far as no container or box is needed, and is accomplished without obscuring the view of the tissue supply as would be the case with opaque boxes.

BRIEF DESCRIPTION OF DRAWINGS

These and other objects, inventive aspects and advantageous features of the present invention will become apparent as the invention becomes better understood by referring to the following, solely exemplary, detailed description of the presently preferred embodiments, and to the drawings, wherein.

DETAILED DESCRIPTION

Figure 1:
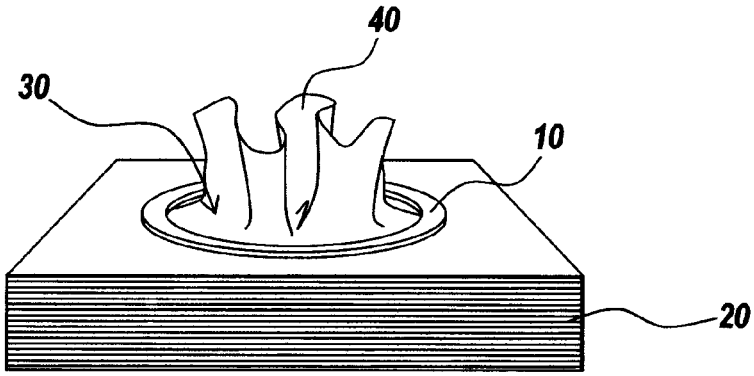
FIG. 1 is a perspective view of a first embodiment of a tissue dispensing apparatus in accord with the present invention.

FIG. 1 illustrates one embodiment of a dispensing apparatus in form of a ring 10. The ring defines an aperture 30. The ring apparatus 10 is positioned over a stack of tissue sheets 20. The tissue sheets 20 are inter-folded such that a top tissue 40 has a portion that is folded with a lead portion of a following tissue. The first tissue 40 can the removed by pulling its lead portion through the aperture 30. The lead portion of the following tissue will be drawn through the aperture 30 such that, as the first tissue is removed from the stack of tissues, at least a portion of the following tissue extends through the aperture 30.

The dispensing apparatus 10 is positioned on top of the stack of tissues 20. The dispensing apparatus 10 has a weight that provides downward pressure on the stack of tissues 20. The downward pressure provides a friction between adjacent tissues, and only one lead tissue will be drawn through the aperture 30. A proper sizing and weight of the apparatus will allow the following sheet to extend through the aperture such that the following tissue becomes at least partially dispensed through the aperture. In the presently preferred embodiment, the ring measures three and one fourth (3.25) inches inside diameter, and is formed out of (0.375) inch round rod stock, welded into a closed loop. It weighs about six (6) ounces.

There is an inverse relation between the weight of the ring 10 and the size of the opening 30 necessary to provide continuous, tear-free tissue dispensation without lifting the ring during use. When the opening 30 is around three (3) inches, the weight of the ring 10 needs to be between three (3) and eleven (11) ounces to function satisfactorily. Less weight allows the ring to lift up with the tissue being dispensed. More weight holds the tissue too tightly, sometimes causing tearing.

The opening may vary in size. In general, smaller openings require more weight to keep the device from lifting. When the diameter of a circular opening, for example, is around two and one-half (2.5) inches, the tissues tend to bind up on each other, causing the device to be lifted unsatisfactorily when a tissue is being dispensed. More weight, however, may cause the tissues to tear.

This device could be made out of many materials or combination of materials including but not limited to metal, glass, plastic, wood, stone, and ceramic, and could be made solid or articulated by multiple pieces, such as a chain of linked members, as long as the size of the opening and the total weight are within acceptable range as discussed above. The same constraints as to aperture size (not so small as to cause binding) and structural member weight (not so heavy as to induce tearing nor so light as to lift off the stack during use) apply to other embodiments described herein and are not again separately described for the sake of brevity of explication.

Figure 2:
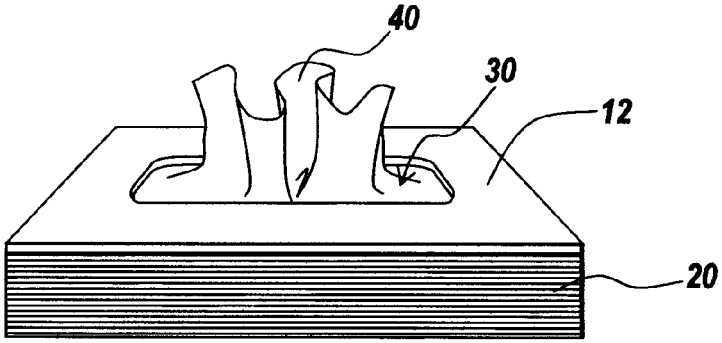
FIG. 2 is a perspective view of a second embodiment thereof.

FIG. 2 illustrates yet another embodiment of the present invention. A plate structure 12 is shown having an aperture 30 dispensing tissue and a plate area 12 extending across substantially the entire remaining top surface of the tissue 20. The aperture 30 may take on any shape sufficient for dispensing the tissue such as a circular, oval, rectangular, square, amorphous, or any other such shape. The remainder of the top tissue 40 is substantially covered by the plate structure 12 for allowing dispensing of the top tissue 40.

Figure 3:
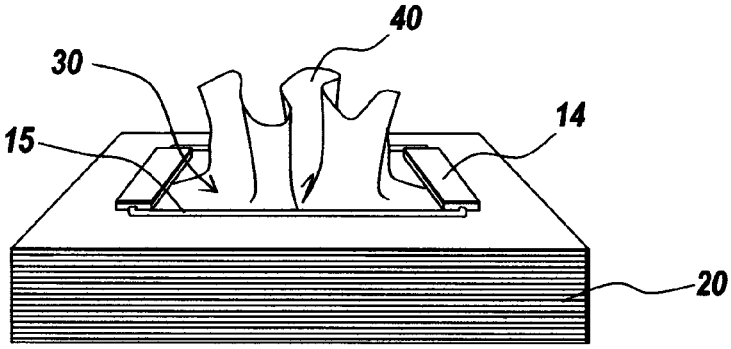
FIG. 3 is a perspective view of a third embodiment of a tissue dispensing apparatus in accord with the present invention.

FIG. 3 illustrates a multiple-piece tissue dispensing aperture 30. The dispensing aperture 30 has structures 14 separated by a space 30. The space between the two structures 30 is a dispensing aperture 30 for dispensing the tissue 40. The structures 14 may take a variety of shapes, sizes, and weights such that they allow for the dispensing of tissue from between the two structures. A connecting element 15 may be placed between the two structures 14 to maintain the spacing between the two structures 14. The connecting element may be flexible or rigid and of any variety of materials such as string, rope, a chain, a link, or any material that the structure may comprise such as metal, plastic, ceramic and the like or any combination of materials.

Figure 4:
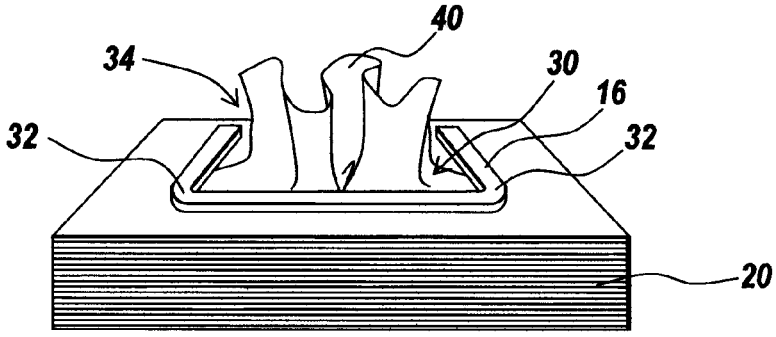
FIG. 4 is a perspective view of a fourth embodiment of a tissue dispensing apparatus in accord with the present invention.

FIG. 4 illustrates a U-shaped or horseshoe structure 16 for dispensing a tissue 40. The U-shaped structure 16 has an open area 30 for dispensing tissue 40. The open area 30 is the area bounded by the curved area 32 within the U-shaped structure 16. The portion of the open area near the legs 34 of the U-shaped structure 16 is unbounded. A variety of shapes may be utilized to provide an open area 30 for dispensing a tissue 40 wherein a portion of the open area for dispensing tissue is unbounded.

The present invention provides for a tissue dispensing apparatus for dispensing a top tissue 40 from a stack of tissues 20. According to the present invention, the top tissue 40 is dispensed by removing the top tissue from the tissue dispensing area, space, or aperture. After the top tissue is dispensed, at least a portion of the following tissue will be drawn through the dispensing area, space or aperture 30.

The shape of the dispensing aperture 30 may be circular, oval, square, rectangular, triangular or any such shape including a random and non-symmetrical shape. Any shape may be used according to the present invention for forming an aperture for dispensing tissue therethrough.

The aperture 30 may be provided by walls made of a variety of materials such as metal, glass, plastic, wood, stone, ceramic or any other such suitable material allowing for a size and weight that allows tissue to be properly dispensed.

In any embodiment of a tissue dispenser in accord with the present invention, the apparatus maintains its position on the stack by means of its enclosing the tissue drawn upwardly through its aperture. Forces generated by an upward tissue draw maintain it at the location it was originally seated. In this manner, it centers itself on the stack about the tissue being pulled upwardly.

The stack of tissues could be contained within a flexible package such as of a plastic wrap. The present invention can be attached to be flexible package or free-standing. The tissue can then be dispensed through the aperture of the present invention when the flexible package has a slit, an opening, or an aperture allowing the tissue to be dispensed therethrough and into the aperture or dispensing area of the present invention whether it is attached to the flexible package or free-standing. Alternately, the flexible package may have a removable top portion or otherwise removed to allow the present invention to be placed thereon on top of the stack of tissues for dispensing the tissues.

The invention claimed is:

1. A method using a ring to dispense sheet material from a stack of sheet material comprising the steps of:

placing said ring on top of said stack of sheet material so that it is supported thereon with its weight downwardly compressing said stack of sheet material with a constant compressive force provided by action of gravity; and drawing a sheet of sheet material from the top of said stack of sheet material upwardly through said ring to dispense it from said stack of sheet material;

wherein said stack of sheet material is an interleaved stack of tissue sheet material, wherein drawing a tissue sheet from the top of said stack of interleaved tissue sheet material during said sheet drawing step to dispense it brings the next-to-top tissue sheet of said stack of interleaved tissue sheet material through said ring in ready position to be dispensed, and wherein said ring has an inside diameter of about three (3) inches, is made of steel, and weighs between three (3) and eleven (11) ounces.

2. A tissue sheet dispenser for dispensing tissues individually off of a stack of tissues, comprising:

a free-standing stack of tissues;

a free-standing tissue dispensing member adapted to seat upon said free-standing stack of tissues having a first, open portion adapted to allow the tissue on the top of said free-standing stack of tissues to be pulled through said first, open portion to dispense it from off of said free-standing stack and having a second, weighted portion cooperative with said first, open portion adapted to so compress the tissues of said free-standing stack of tissues upon which it is seated as to remain seated thereon when the top tissue is pulled through said first, open portion to dispense it without tearing the tissue being dispensed;

wherein said first open portion of said free-standing tissue dispensing member is an unbounded open portion, and wherein said unbounded open portion is U-shaped.

3. The tissue sheet dispenser for dispensing tissues individually off of a stack of tissues of claim 2, wherein said stack of tissues is a stack of interleaved tissues.

4. The tissue sheet dispenser for dispensing tissues individually off of a stack of tissues of claim 3, wherein said second, weighted portion cooperative with said first, open portion of said free-standing tissue dispensing member adapted to so compress the tissues of said stack of tissues upon which it is seated as to remain seated thereon when a top tissue is pulled through said first, open portion to dispense it without tearing the tissue being dispensed is further adapted to prevent tearing of the next-to-top tissue of the stack of interleaved tissues when a top tissue is pulled through said first, open portion to dispense it and the next-to-top tissue is thereby drawn into the first, apertured portion in ready position to be dispensed.

5. A tissue sheet dispenser for dispensing tissues individually off of a stack of tissues, comprising:

a free-standing stack of tissues;

a free-standing tissue dispensing member adapted to seat upon said free-standing stack of tissues having a first, open portion adapted to allow the tissue on the top of said free-standing stack of tissues to be pulled through said first, open portion to dispense it from off of said free-standing stack and having a second, weighted portion cooperative with said first, open portion adapted to so compress the tissues of said free-standing stack of tissues upon which it is seated as to remain seated thereon when the top tissue is pulled through said first, open portion to dispense it without tearing the tissue being dispensed;

wherein said second, weighted portion of said free-standing tissue dispensing member is integrally formed, and wherein said second, weighted portion of said integrally formed free-standing tissue dispensing member is a ring.

* * * * *